US007340982B2

(12) United States Patent
Wright et al.

(10) Patent No.: US 7,340,982 B2
(45) Date of Patent: Mar. 11, 2008

(54) WRENCH

(75) Inventors: Richard B. Wright, Akron, OH (US); Kenneth R. Milligan, Akron, OH (US)

(73) Assignee: Wright Tool Company, Barberton, OH (US)

( * ) Notice: Subject to any disclaimer, the term of this patent is extended or adjusted under 35 U.S.C. 154(b) by 124 days.

(21) Appl. No.: 11/091,276

(22) Filed: Mar. 28, 2005

(65) Prior Publication Data

US 2005/0166720 A1 Aug. 4, 2005

Related U.S. Application Data

(63) Continuation of application No. 10/202,157, filed on Jul. 24, 2002, now Pat. No. 6,907,805.

(51) Int. Cl.
*B25B 13/02* (2006.01)

(52) U.S. Cl. ..... 81/119; 81/121.1; 81/186

(58) Field of Classification Search ..... 81/119, 81/121.1, 186

See application file for complete search history.

(56) References Cited

U.S. PATENT DOCUMENTS

| | | | | |
|---|---|---|---|---|
| 996,841 | A | | 7/1911 | Dixon |
| 3,242,775 | A | | 3/1966 | Hinkle |
| 4,598,616 | A | | 7/1986 | Colvin |
| 4,882,957 | A | | 11/1989 | Wright et al. |
| 5,012,706 | A | | 5/1991 | Wright et al. |
| 5,074,171 | A | * | 12/1991 | Annis et al. ..... 81/119 |
| 5,117,714 | A | | 6/1992 | Pagac et al. |
| 5,148,726 | A | * | 9/1992 | Huebschen et al. ..... 81/119 |
| 5,284,073 | A | | 2/1994 | Wright et al. |
| 5,381,710 | A | | 1/1995 | Baker |
| 6,145,414 | A | | 11/2000 | Hsieh |

OTHER PUBLICATIONS

*Wright Tool, 75th Anniversary Catalog 175*, pp. 261, 262, Jan. 2002.

* cited by examiner

*Primary Examiner*—Joseph J. Hail, III
*Assistant Examiner*—Shantese McDonald
(74) *Attorney, Agent, or Firm*—D. Peter Hochberg; Sean Mellino

(57) ABSTRACT

Open-end symmetrical wrenches retain fasteners fully seated in the jaws of the wrench. The jaws have fastener-engaging surfaces with substantially planar and parallel sections that extend past the front side corners of the fastener when it is fully seated in the wrench and serrated diverging sections extending outwardly and rearwardly from these planar sections. The serrated diverging section may be arcuate or a slightly inclined. Both types of diverging section are designed to reduce slipping and are connected to rear corners of the fastener-engaging cavity that are designed and positioned to avoid contact with the rear side corners of the fastener. Arcuate rear side corners of the wrench cavity avoid contact with the rear side corners of the fastener and avoid stress concentration points. The throat that connects the corners has two gentle curves or flat surfaces leading to a central arc. This modified "U" design provides more metal in the throat of the wrench, which stiffens the jaws.

3 Claims, 6 Drawing Sheets

WRENCH

CROSS REFERENCE TO RELATED APPLICATION

This application is a continuation of U.S. patent application Ser. No. 10/202,157 filed Jul. 24, 2002 now U.S. Pat. No. 6,907,805.

BACKGROUND OF THE INVENTION

1. Field of the Invention

This invention relates to wrenches and, in particular, to open wrenches for turning hexagonal or other polygonal fasteners.

2. Description of the Prior Art

Wrenches with open-ended or open-sided hexagonal fastener-engaging cavities (referred to herein collectively as "open" wrenches), are designed to engage hexagonal fasteners by being moved in the direction of the axis of the fastener, or at right angles to the axis. They are not only more convenient to engage, they are able to engage fasteners that other styles of wrenches, such as socket or box wrenches, are unable to engage because the ends of the fasteners are not accessible. Engaging the fastener on a tubing fitting is a good example.

Unfortunately, open-end wrenches are not nearly as strong as box or socket wrenches, but it is desirable to tighten or loosen the fasteners to the same level as socket and box wrenches, if the fasteners are to do their job. Open wrenches, whether with fixed jaws as in the design customarily referred to as "open-end" or with adjustable jaws such as Crescent®, Stillson or pipe wrenches, must meet various design criteria. They must be strong and stiff enough to transmit torque to nuts, bolts and other fasteners with polygonal heads. Both stiffness and strength are important because wrenches can fail either by the jaw breaking, or by the jaw spreading apart in such a manner that the fastener turns, or the fastener turns part way and then the corners of the fastener yield, allowing the wrench to turn the rest of the way without turning the fastener.

Open wrenches have a tendency to spread under load. This lets the fastener rotate in the wrench, which tends to allow the wrench to move relative to the fastener, damaging the corners of the fastener. Under heavy loads, the wrench may move relative to the fastener in such a way that the fastener rotates toward the outside of the wrench opening, which is a much weaker position of engagement, and can result in damage to the wrench or the fastener. Thus, another important feature of an improved open-end wrench design is to keep the fastener fully seated in the wrench opening, preferably touching the base of the wrench opening or throat, so as to minimize the bending moments on the jaws. It is for this reason that it is undesirable to have the fastener "walk" out of the wrench opening as a result of relative rotation of the wrench and fastener. This can occur even if the user has properly positioned the wrench all the way on to the fastener. Shifting may occur under load as a result of the deflections and deformations occurring under load.

FIGS. 1 and 4 illustrate a standard wrench 10 with substantially planar sides or jaws 13, 14 joined to a generally "U" shaped back or throat 18. The wrench is shown in the conventional tightening position, turning or torquing the fastener clockwise. FIGS. 2, 3, 5, 6 and 8 and the solid line view of the fastener in FIG. 7 show wrenches and fasteners in similar positions. The phantom or dotted line view of the fastener in FIG. 7 illustrates the "neutral" or unloaded position. In this position the sides of the fastener are generally parallel to the jaws of the wrench, which do not apply torque to the fastener in either direction.

The fasteners with which the inventive wrench is used are polygonal fasteners having opposing pairs of parallel sides each of which join adjacent sides at a corner. The wrench jaws engage or grip an opposing pair of parallel sides 231, 261. As discussed herein, the corners of the gripped sides proximal the wrench opening are referred to as front side corners 24, 26, and the corners proximal the throat of the wrench are referred to as rear side corners 23, 27. The gripped sides 231, 261 of the fastener have forward portions proximal the wrench opening and rear portions proximal the throat. The fasteners included in the discussion herein are hexagonal in shape, but the invention is not so limited. The corner of a hexagonal fastener proximal the wrench throat is referred to as rear corner 22.

The contact points and forces between the jaws and fastener are interchanged to transmit torque in the opposite direction. Because of this, wrench 10 is symmetrical about the centerline or axis of symmetry CL of fastener-engaging opening 16, as are almost all open-end wrenches.

This wrench is susceptible to the problems discussed above. The curved back avoids stress concentration points, but it reduces the amount of metal in the head 11 of the wrench. This weakens the wrench and reduces its stiffness. As the load is increased, the jaws of the wrench will tend to spread apart elastically and the corners of the fastener will tend to deform both elastically and plastically. To be in static equilibrium, the wrench must make contact with at least two points on the fastener as this is occurring. Since the shapes are changing, there must be relative motion between the wrench and the fastener. This will require rotation about either the left front side corner or point 24 of the fastener or the right rear side corner or point 27, as shown in FIG. 4, on a basis of chance. If rotation happens to occur about point 24, the rear side corner or point 23 of the fastener moves away from contact with the wrench, point 27 moves toward the open end 16 of the wrench, force B moves further out in the opening, and the location of force A remains the same. In that case, the magnitude of forces A and B must increase to apply the same amount of torque to the fastener, because the applied torque is equal to the value of force A times distance a plus the magnitude of force B times the distance b. This increase in force causes the jaws to spread further than they would had the rotation occurred about corner 27. If the rotation occurs at corner 27, contact will still be maintained at point 27, and there will be no significant change in the location and magnitudes of forces A and B. In the wrench shown in FIG. 4, either mode of loading occurs by chance. This invention biases the contacts in such a way that rotation is about point 27 rather than about point 24 when the rotation is clockwise and, therefore, the forces are as shown.

FIG. 2 shows another conventional open wrench 30, which differs from the wrench in FIG. 1 by having a V-shaped back or throat 38, with sharp corners 381, 383 where the throat meets the planar sides 331, 341 of the wrench, and another sharp corner 382 at the central axis X of the fastener-engaging cavity 36. The cross-hatched area between the V-shaped back 38 and the phantom outline of the U-shaped back of the wrench in FIG. 1 is additional metal that strengthens the jaws 33, 34 of wrench 30. Unfortunately, corners 381, 382 and 383 are stress concentration points that weaken this wrench.

A variety of open designs have been adopted or proposed in attempts to provide wrenches that come closer to meeting these goals than conventional polygonal wrenches, which have substantially planar sides and sharp corners. Representative examples are provided by U.S. Pat. No. 3,242,775 to Hinkle, U.S. Pat. No. 5,117,714 to Pagac et al, and U.S. Pat. No. 5,381,710 to Baker. All offer advantages, but all of these designs also suffer from disadvantages. Hinkle provides inclined surfaces at both the inner and outer end of his fastener-engaging surfaces. This reduces the tendency to exert pressure on the corners of the fastener, but it reduces the length of the moment arm of the force couple on the fastener, i.e. the product of the forces applied to the fastener times the lengths of the distances from the force vector to the central axis of the fastener. For example, in the conventional U-shaped wrench shown in FIG. 4, the torque applied to fastener 20 is equal to force vector A times moment arm a plus force vector B times moment arm b. This reduction in Hinkle of the length of the moment arm about the axis of the fastener increases the force that must be exerted by the jaws to generate an equivalent amount of torque. The problem gets worse if the fastener "walks" or slips part way out of the wrench. This lengthens the moment arms m and n on jaws 13 and 14, i.e. the distance from the base of throat 18 to the points where force vectors A and B are applied to the fastener. Like many currently available open-end wrenches, Hinkle does not have any way to grip the side of the fastener securely, which makes his design prone to slip, and increase the force couples on the jaws of the wrench. This increases the risk that the jaws will fail, or be deformed enough to allow the fastener to slip and be damaged.

Pagac et al provide serrations on the fastener-engaging jaws of their wrench. But the jaws also have relief regions to prevent the front corners of the fasteners from contacting the jaws. As with the Hinkle design, this shortens the force couple arm and increases the force and torque that must be applied by the wrench to torque the fastener by the same amount. Baker's curved fastener-engaging jaws suffer from similar problems. If the fastener is not fully seated in Pagac's jaws, the same force must be applied at points further out on the jaws, increasing the bending torque on the jaws of the wrench.

U.S. Pat. No. 5,148,726 (Huebschen et al.), like Pagac et al., comprises an open-end wrench with a curved throat, opposing jaws each having serrated regions near the throat, and a recess or relief region near the opening of the wrench for receiving the corner of a fastener seated in the wrench to protect the corner of the wrench. However, this severely limits the effectiveness of the wrench. When a hexagonal fastener is received in the wrench with one corner near the center of the throat and the wrench is turned to turn the fastener, there is no surface on the wrench to urge the latter corner of the fastener towards the throat. Therefore, the corner of the fastener near the center of the throat of the wrench cannot be driven by the surface of the throat. Therefore, the only corners (or surfaces close to the corners) being engaged by the wrench are the one corner at the foregoing relief region and the corner on the other side of the wrench next to the throat. Moreover, the tip of the serration in U.S. Pat. Nos. 5,117,714 and 5,148,726 closest to the relief region of the wrench embeds itself into the fastener near the corner, and pushes the corner back towards the throat. Moreover, the serrations of the prior art wrenches disclosed in the latter patents engage the fastener first near the corner and proceed to engage the fastener as the wrench turns at increasing distances from the corner. Therefore, wrenches of the foregoing prior art not only detract from the turning force by reason of the relief region, but further damage the fastener as well. The present invention, as discussed below, makes an important improvement in that the wrench engages three—and often four—corners of the fastener and tremendously increases the torque applied to the fastener, the serrations engage the fastener away from the corner and do not damage the fastener as turning force is applied to the wrench.

SUMMARY OF THE INVENTION

It is an object of the present invention to provide an improved open-end wrench for fully seating a nut, bolt or other fastener with a polygonal head for reducing the tendency of the jaws of the wrench to bend or to break.

Another object of the invention is to provide an improved open-end wrench for preventing the tendency of a fastener to slip out of the wrench.

A still further object of the invention is to provide an improved open-end wrench for securely gripping a fastener when the wrench turns the fastener.

Yet another object is to provide an improved open-end wrench for providing a force couple with a long moment arm about a fastener to reduce the force required to turn the fastener with the wrench.

It is an object of the invention to provide an improved open-end wrench having serrated diverging sections for engaging one side of a fastener being turned, and sections for concentrating the turning force on a corner on the other side of the fastener.

A yet further object is to provide an improved open-end wrench having curved surfaces for preventing stress concentrations.

These and other objects will be apparent to those skilled in the art from the description to follow and in the appended claims.

Open wrenches embodying this invention retain fasteners fully seated in the open fastener-engaging cavity of the wrench. This reduces the forces tending to bend or break the jaws of the wrench, and reduces the risk of slipping off or damaging the fastener. The jaws of the wrench have fastener-engaging surfaces with substantially planar and parallel sections proximal the wrench opening that extend past the front side corners of the fastener when it is fully seated in the cavity. Serrated diverging sections extend outwardly and rearwardly toward the throat from said planar sections. These serrated diverging sections provide a secure grip on the side of the fastener when the wrench turns about the axis of the fastener. At the same time, the planar section of the opposite jaw, which extends past the opposite front corner of the fastener, provides a force couple with a long moment arm, which reduces the force required.

The serrated diverging section may be arcuate or slightly inclined away from the central axis of the wrench proximal the throat of the wrench. With either design, the position where the diverging section contacts the side of the fastener will depend on the torque required and the clearance between the fastener and the fastener-engaging surface. Both types of diverging sections are designed to reduce slipping and are connected to rear corners of the fastener-engaging cavity (i.e. the opposite end portions of the throat), which corners are designed and positioned to avoid contact with the rear side corners of the fastener.

Wrenches embodying this invention are both stronger and stiffer than conventional open-end wrenches. The rear side corners of the wrench cavity are arcuate. In addition to avoiding contact with the rear side corners of the fastener, the arcuate corners avoid stress concentration points. The throat that connects the corners also avoids concentration points. Two gentle curves or flat surfaces lead to a central arc in the throat that limits the rearward movement of the fastener in the wrench cavity, but permits the rear end of the fastener to move laterally, which minimizes damage to this corner. The smooth curve from the arcuate corners to the gentle arcs or flat surfaces to the central arc in the throat minimizes stress concentration, and the gentle arcs or flat surfaces of this modified "U" design provide more metal in the throat of the wrench, which stiffens the jaws. This reduces deflection of the jaws under load.

Other advantages of this invention will be apparent from the following description.

DETAILED DESCRIPTION OF THE PREFERRED EMBODIMENT

Figure 3:
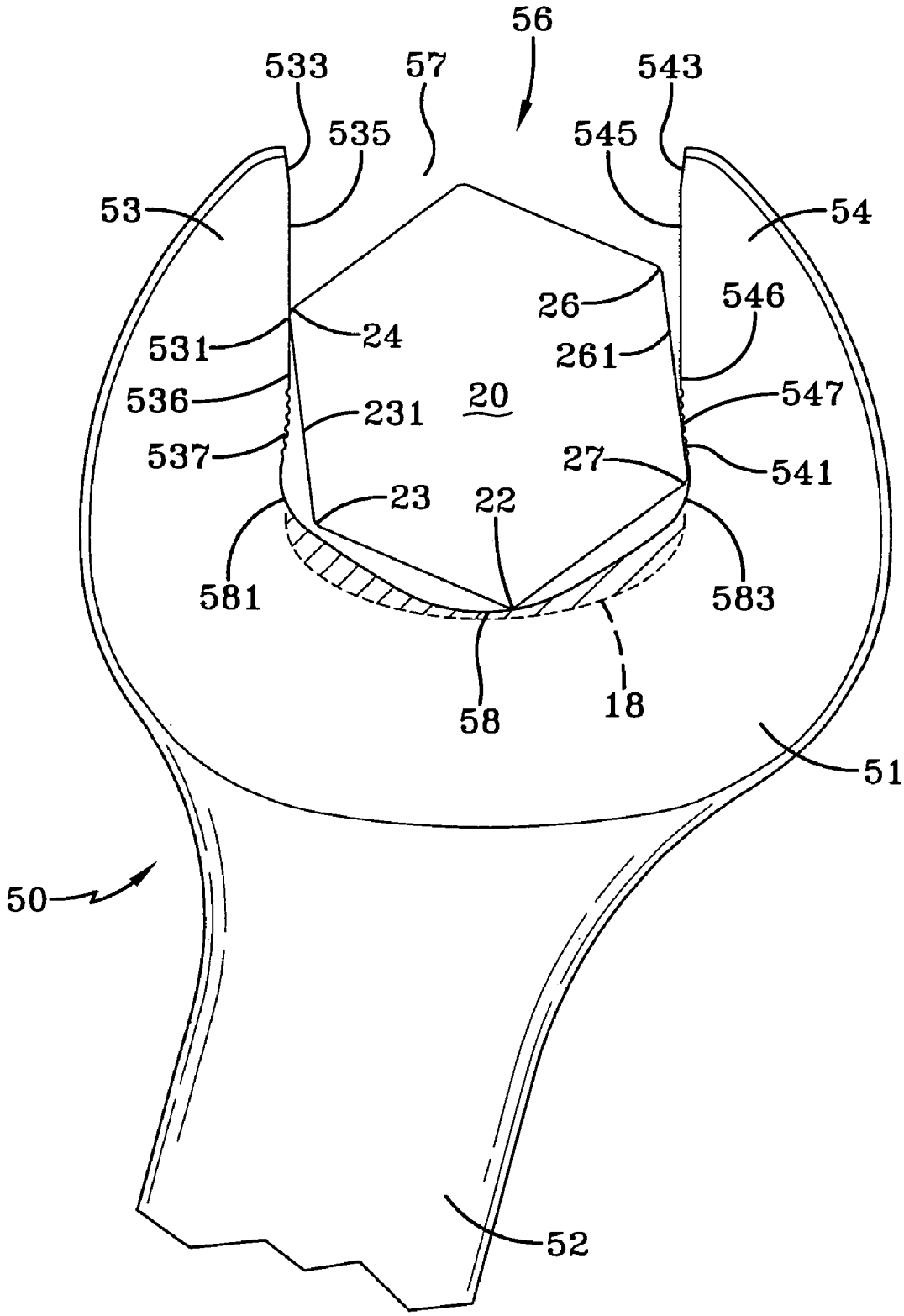
FIG. 3 illustrates an open wrench embodying this invention.
Figure 4:
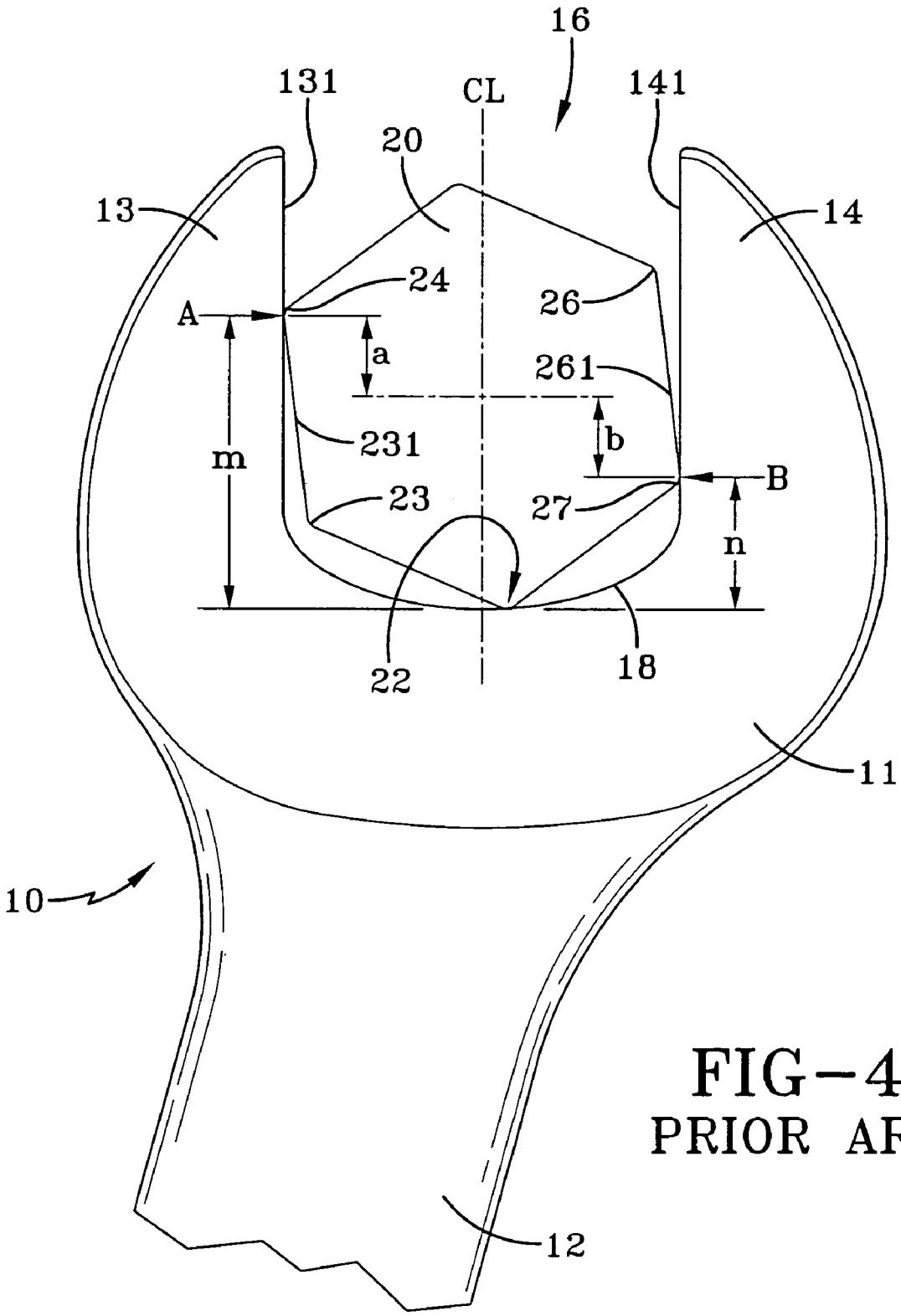
FIG-4 PRIOR ART
FIGS. 4 and 5 are enlarged views, respectively, of the conventional wrench in FIG. 1 and the wrench in FIG. 3, which embodies this invention.
Figure 5:
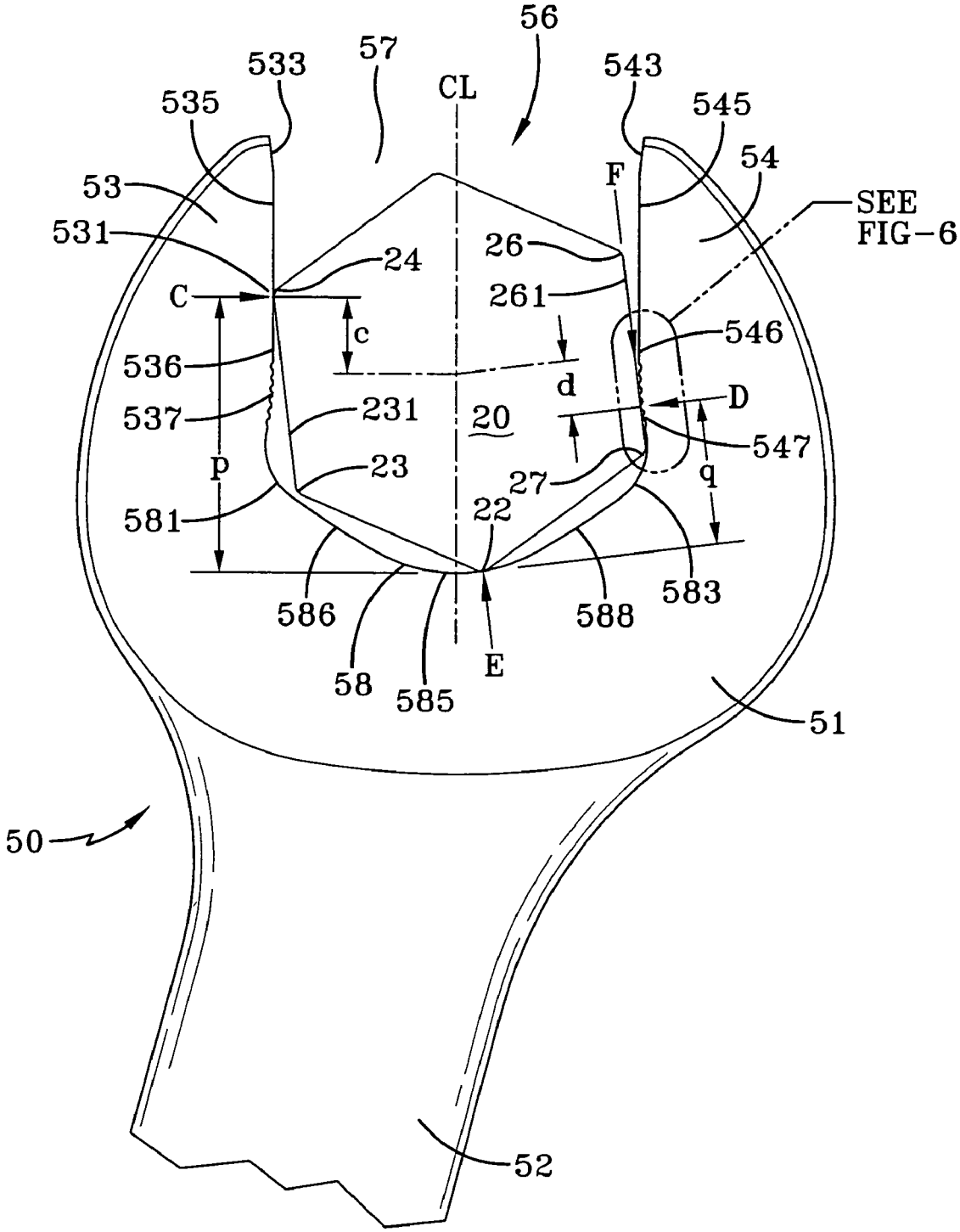

FIG. 3 and 5 illustrate an open-end wrench 50 embodying this invention. This wrench has a head 51 and an attached handle 52 for turning the head. Head 51 has two fixed jaws 53, 54, connected by a throat 58. Jaws 53 and 54 and throat 58 define an open-ended fastener-engaging cavity 56, i.e. a cavity with an opening 57 at the end of the cavity so that the cavity can be slipped onto a nut 20 or similar fastener of the same basic size as the cavity. Terms such as "fastener," "fastener-engaging cavity," "fastener-engaging surface" and the like are used herein for simplicity. It should be understood that these terms are meant to cover nuts, bolts, screws with polygonal heads and other fasteners designed to be gripped and/or manipulated by tools with polygonal openings, and tools for gripping and manipulating such fasteners. Similarly, as mentioned above, terms such as "open," "open-end" and the like should be understood to cover both wrenches with fixed jaws, as shown in the Figures, and wrenches with adjustable jaws such as Crescent® wrenches, Stillson wrenches and pipe wrenches. Each of the jaws 53, 54 has a fastener-engaging surface 531, 541 with several distinct sections designed to improve the performance of the wrench. At the front end of cavity 56, adjacent to opening 57, each fastener-engaging surface has chamfers 533, 543 that facilitate engagement of the fastener. These chamfers lead to two substantially parallel planar sections 535, 545 that define the basic size of the wrench.

When fastener 20 is fully inserted into the fastener-engaging cavity 56, i.e. when the rear corner 22 of the fastener is touching or near throat 58, the front ends of planar sections 535, 545 extend past the front side corners 24, 26 of the fastener. The rear or inner ends of these sections extend to points 536, 546 proximal throat 58 between the front side corners and the rear side corners 23, 27 of the fastener. At these points the parallel planar sections 535, 545 connect to two serrated, diverging sections 537, 547 that extend to the rounded rear corners 581, 583 of the fastener-engaging cavity. Points 536, 546 are preferably near the center of the sides 231, 261 of the fastener when the wrench is in the "neutral" position.

Fasteners, and fixed-jaw wrenches, are produced to established standards, designed to ensure that the largest fastener that meets specifications for a given nominal size will fit into the smallest wrench of that size. Conversely, the smallest fastener of any nominal size must be gripped and turned by the largest wrench for that size. There will always be some clearance between the fastener and wrench. The clearance will be minimal with a large fastener and small wrench, and larger with a small fastener and large wrench. This clearance dictates the "free swing" for any given fastener and wrench, i.e. the amount of free rotation of the wrench from the to the loaded or tightening position shown in FIGS. 1-5 to the opposite or loosening position.

Figure 6:
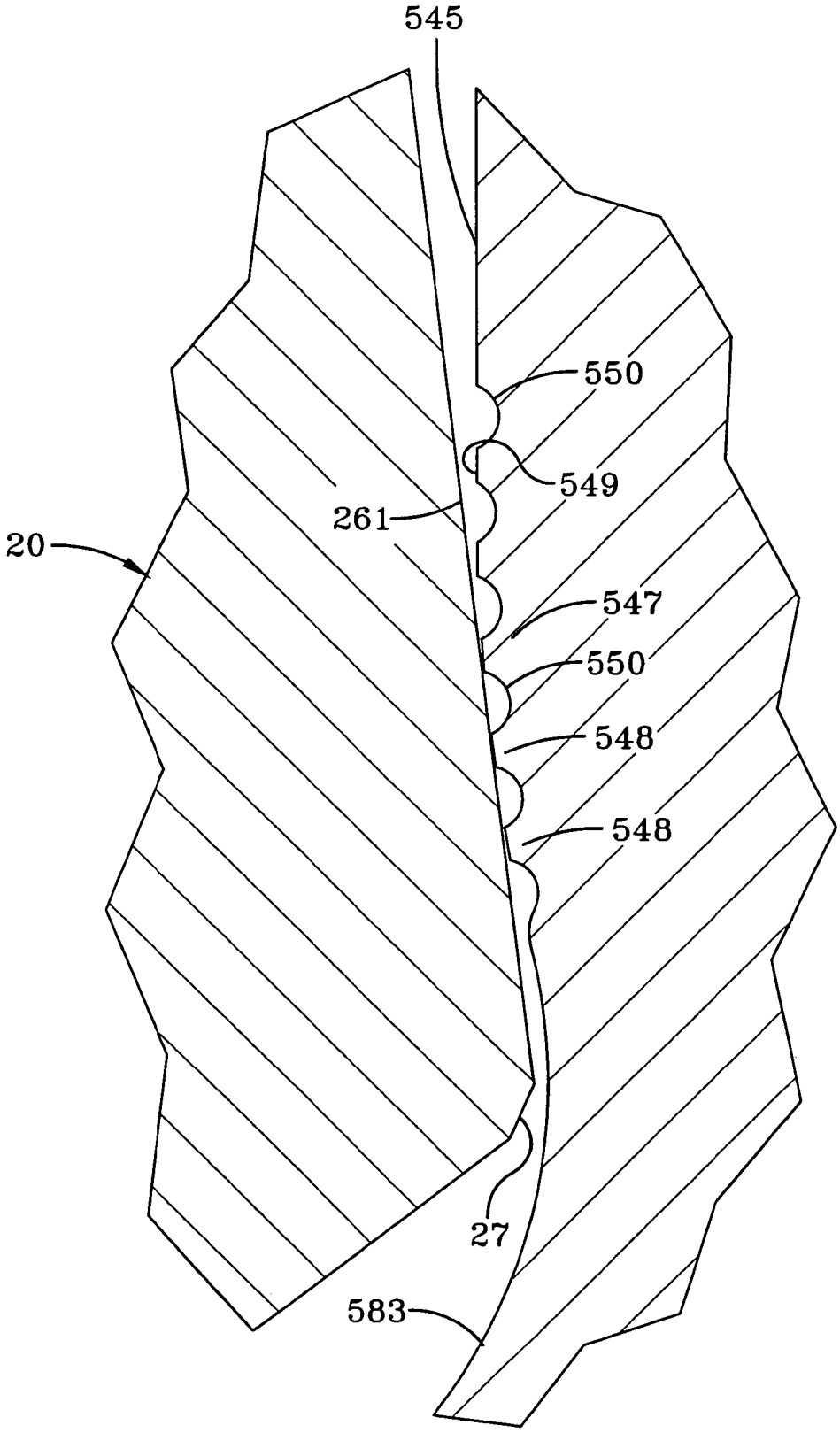
FIG. 6 is an enlarged, fragmentary view of one diverging section of a jaw of the wrench shown in FIGS. 3 and 5.

Diverging sections 537 and 547 are designed to optimize the relationship of the jaws and fastener relative to each other in the loaded position. As shown in FIG. 6, diverging sections 537 and 547 (diverging section 537 is not shown in these figures but has a complimentary shape) diverge from parallel planar sections 535 (also not shown) and 545 in gentle arcs, preferably with a radius of about (0.9±0.2) times the width of the fastener-engaging cavity 56, i.e. the distance between parallel planar sections 535 and 545. The axes of rotation of the foregoing arcs are located outside of the diverging sections, that is, on the opposite side of the respective diverging sections 537 and 547, from the axis of symmetry. For example, in one open-end wrench shaped as illustrated in FIG. 5, designed for 9/16 inch fasteners, the width of fastener-engaging cavity 56 is about 0.566 inch taken between parallel planar sections 535 and 545, and diverging sections 537, 547 have a radius of about 0.50 inch. These dimensions, and other dimensions of wrench 50, are adjusted proportionally for wrenches of different sizes.

The edges 549 at the tops of serrations 548 (or other irregularities such as grooves, knurls or other projections or protuberances with relatively sharp edges) on diverging section 547 and the rear part of planar section 545 grip the side 261 of the fastener, and help to prevent it from slipping. If the fastener fits snugly in the wrench, or less torque is required, contact may be somewhat farther forward, perhaps on the point 546 where diverging section 547 meets planar section 545. If the fit between the wrench and fastener is looser, or more torque is needed, contact may be further back, as shown in FIG. 6. The serrations are preferably semicircular grooves 550, as shown in these figures, to avoid stress concentration points at the bottoms of grooves 550, and the diverging sections 537 and 547 are designed to contact the fastener on surface 261, not on rear side corner 27. All of the fastener corners are preferably flattened as shown in FIG. 6 to avoid stress concentration on the corner when engaged by a wrench.

Figure 1:
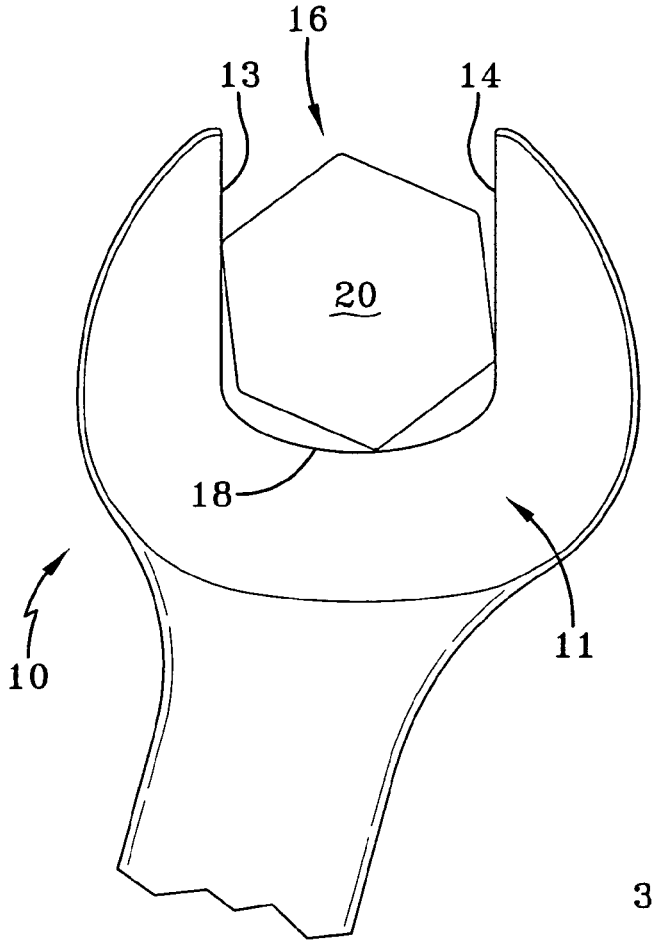
FIG-1 PRIOR ART
FIG. 1 illustrates a conventional open-end wrench with a rounded back or throat.
Figure 2:
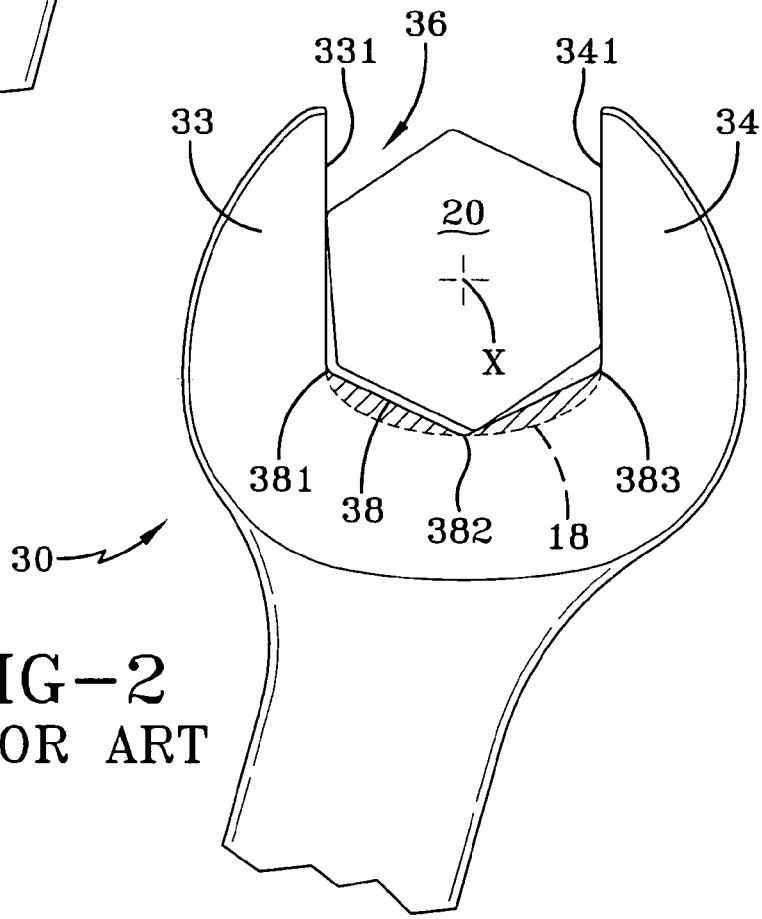
FIG-2 PRIOR ART
FIG. 2 illustrates a conventional open-end wrench with a V-shaped back or throat.

As mentioned above, fastener-engaging surfaces 531, 541 are designed to extend past the front side corners 24, 26 of the fastener when fastener 20 is fully seated in fastener-engaging cavity 56. Thus, when the fastener is torqued as shown in FIG. 2, planar section 535 is in contact with the left front side corner 24 of the fastener. This is true even if the fastener is only partially seated in cavity 56, as long as the left front side corner 24 of the fastener is on planar section 535, i.e. behind the chamfer 533 at the front of the jaw 53 in FIG. 5. This increases the lever arm c of the force on jaw 53 (in comparison to wrenches such as those disclose in the Hinkle, Pagac and Baker mentioned above), and reduces the amount of force that must be applied (vector C). In turn, this reduces the force that must be applied by jaw 53, which reduces the bending torque on the jaw (vector C times moment arm p). The serrations on diverging sections 537 and 547 contribute by keeping the fastener fully seated in the fastener-engaging cavity 56, which shortens moment arm p.

Throat 58 has a modified "U" design that reduces stress concentration and provides more metal in the throat. This stiffens the jaws so that they do not deflect as much under load, which is the means by which open-end wrenches sometimes cease to operate. The center of the throat 58 is a gentle concave or central arc 585 with a radius of about 0.30 inch to about 0.60 inch (preferably about 0.45) times the width of the fastener-engaging cavity 56. Arcuate rear corners 581 and 583 are designed and positioned to avoid contact with the left rear and right rear corners 23, 27 of fastener 20. Thus, damage to the corners of the fastener is reduced.

Arc 585 is connected to corners 581 and 583 by two flat surfaces or gentle arcs 586 and 588. The arcs, if used, have radii of no less than twice the across the flats width of fastener-engaging cavity 56 taken across parallel planar sections 535 and 545. In the 9/16-inch wrench described above, these arcs may have a radius of about 1.5 inch, or almost three times the width of the fastener-engaging cavity 56.

As may be seen in FIG. 3, the cross-hatched area between the modified U-shaped throat 58 and the phantom outline of the U-shaped throat 18 of wrench 10 adds metal to the throat 58 of the wrench, thereby stiffening and strengthening it. Also, since there is a series of gradual linked curves or linking sections from the left fastener-engaging surface 531 through the left rear corner 581, throat 58 and right rear corner 583 to the right fastener-engaging surface 541, there are no stress concentration points where failures would be more likely to occur. The modified U-shaped back or throat of this invention does not add as much metal as a conventional V-shaped wrench. However, avoiding stress concentration points produces a stronger wrench.

Figure 7:
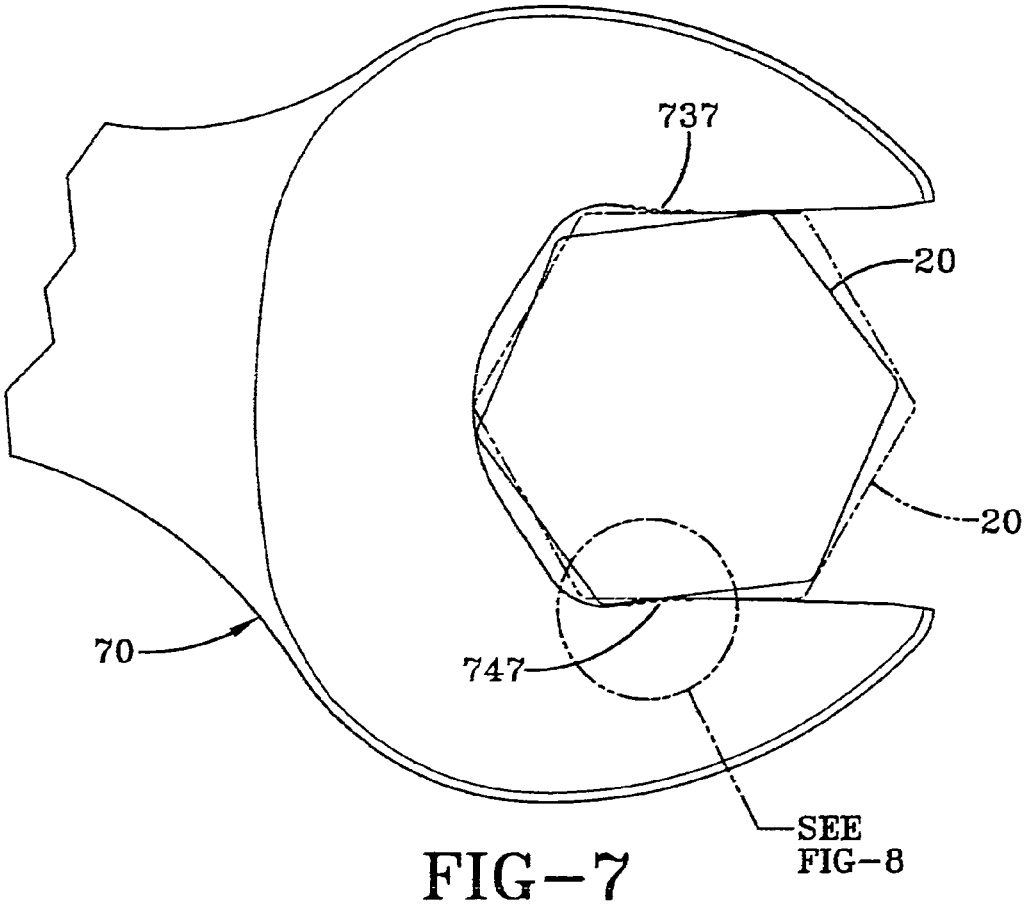
FIG. 7 depicts another open wrench embodying this invention.
Figure 8:
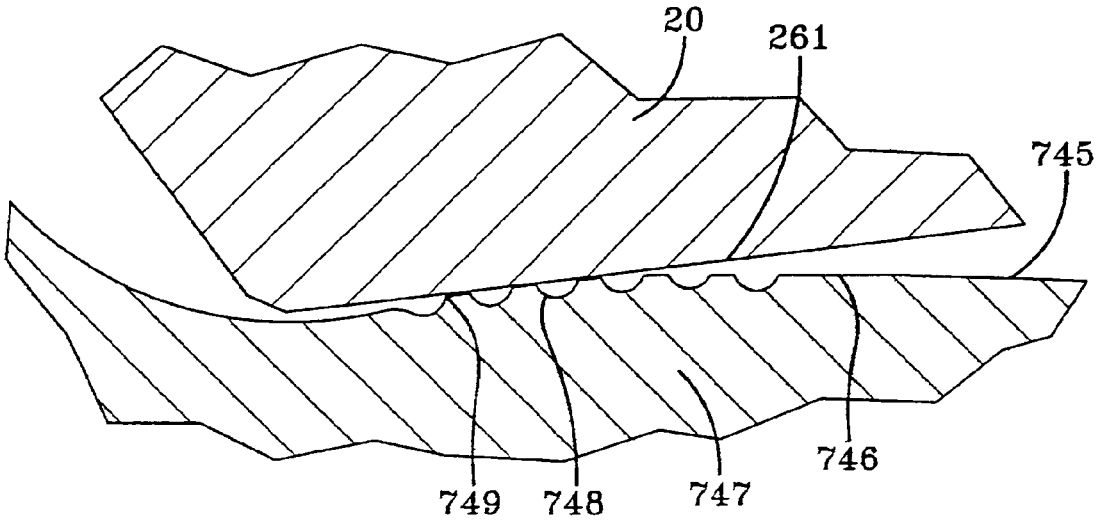
FIG. 8 is an enlarged fragmentary view of one diverging section of a jaw of the wrench shown in FIG. 7.

FIG. 7 illustrates another wrench 70 embodying this invention, with slightly different diverging sections 737, 747. In this embodiment, the tops of the serrations in the diverging sections, one of which diverging section 747 is shown in FIG. 8, each lie in a plane. Each adjacent plane is rotated slightly from the adjacent plane by about 3 to 12° as shown, with the average for all of the planes being about 6° from the planar section 745. When the wrench begins to torque the fastener clockwise, the wrench rotates so that the tips 749 of the serrations contact the right side 261 of the fastener. As the torque and deformation of the wrench and/or fastener increases, the right side 261 of the fastener will lie across more of the tips 749 of the serrations on diverging section 747, as shown in FIG. 8. If the torque and deformation increase still further, the side 261 of the fastener will become embedded in serrations 748, thus preventing the fastener from slipping out of the wrench. Upon sufficient torque being applied by wrench 70 on fastener 20, corner 23 engages the surface or arc corresponding to arc 586, and another force vector is applied to fastener 20 for assisting in turning the fastener.

Those skilled in the art will readily appreciate distinct advantages provided by the wrenches described above. Foremost of these is the ability to transmit as much as 50% more torque to the fastener as a result of more consistent and reliable positioning of the wrench on the fastener under load and because of the stiffening of the jaws. The chance of the wrench slipping off the fastener under heavy loads is greatly reduced. As explained earlier, the present invention is an improvement over the wrenches disclosed in both Pagac et al. and Huebschen et al. Whereas the fastener in each of Pagac et al. and Huebschen et al. is unable to be forcibly engaged by the throat as the wrench is being turned since the forward fastener corner is located in the relief region, only two surfaces of the fastener have force exerted on them—a surface at the forward corner near the opening and the surface near the opposite corner near the throat. As shown in FIG. 5, when the wrench of the present invention is turned clockwise to tighten the fastener, force C is applied to front side corner 24, force E is applied to rear corner 22, and force D is applied to or near rear side corner 27. In some situations, another force could be applied to rear side corner 23. The application of the foregoing forces to the fastener puts significant forces with resulting torques on the fastener without applying possibly damaging forces to the wrench, rendering the wrench of the present invention markedly superior to the wrench of Huebschen et al.

A wrench according to the present invention will probably result in some rounding of the corners if a heavy load is applied to the fastener. However, the amount of damage to the fastener is reduced over wrenches now in use. Likewise, the amount of distortion of the shape which might interfere with future wrenching is also reduced as compared with presently known wrenches.

Of course, while the invention has been described in detail, with particular emphasis on preferred embodiments, those skilled in the art should also appreciate that many variations and modifications to and variations of the embodiments described herein within the spirit and scope of this invention, which is defined by the following claims.

We claim:

1. A symmetrical open-end wrench with a fastener-engaging opening having an axis of symmetry, said wrench comprising:

fastener-engaging surfaces comprising forwardly disposed substantially planar sections extending parallel to and on opposite sides of said axis of symmetry;

rear side corners of said opening, said rear side corners comprising arcs that curve outwardly from a geometric projection of said respective substantially planar sections and away from said axis of symmetry, for reducing or eliminating stress concentrations at said rear side corners;

a throat interconnecting said rear side corners, said throat having a configuration of a "U" on the axis of symmetry, said "U" configuration having opposing relatively large internal curved corners and an internal central portion between said latter corners, said "U" configuration being modified with material being included in said opposing relatively large internal corners and said central portion of the "U" to create relatively small internal corners to improve the strength of said wrench compared to a wrench absent said included material, said central portion having a higher degree of concavity than the remainder of said throat; and outwardly diverging sections being disposed between said substantially planar sections and said rear side corners of said opening, said diverging sections diverging both from the respective planar sections and from said rear side corners of said opening, and being located on opposite sides of said axis of symmetry and extending away from said axis of symmetry from the front towards the rear of said outwardly diverging sections, said diverging sections including irregularities that grip a fastener in said opening and having smooth cornerless surfaces merging with said rear side corners.

2. An open-end wrench with a fastener-engaging opening, said wrench comprising:

a throat having a gentle concave central portion, said central portion having a higher degree of concavity than the remainder of said throat, said throat terminating at opposing throat ends, wherein there is more material in at least one portion of said throat between said central portion and at at least one of said throat ends than would exist if said throat at said at least one portion were defined by a part of a circle having a radius of curvature extending from an axis of rotation defined by an axis equidistant from said throat ends and from said central portion, said circle extending to said central portion and to said at least one throat end, said more material increasing the strength at said at least one portion of said throat;

a pair of opposing jaws defining the opening opposite said throat, and opposing sections having substantially planar fastener-engaging sections facing each other across the entrance of said opening;

at least one of said jaws having at least one tooth proximate one of said planar fastener-engaging sections on said jaw; and the opposing section of at least one of said jaws joining said at least one of said throat ends proximate the jaw opposite said jaw with said at least one tooth, for reducing or eliminating stress concentrations at said at least one throat end.

3. An open-end wrench according to claim 2 wherein said jaws each have chamfers disposed forwardly of said planar fastener-engaging sections.

* * * * *